US005895214A

United States Patent [19]

Nichols

[11] Patent Number: 5,895,214

[45] Date of Patent: Apr. 20, 1999

[54] KILN CLOSURE MECHANISM

[75] Inventor: John Warr Nichols, Warwick, United Kingdom

[73] Assignee: The Ruby Group, PLC, Warwickshire, United Kingdom

[21] Appl. No.: 08/315,824

[22] Filed: Sep. 30, 1994

[30] Foreign Application Priority Data

Oct. 5, 1993 [GB] United Kingdom ..... 9320466

[51] Int. Cl.[6] ..... F23B 7/00

[52] U.S. Cl. ..... 432/117

[58] Field of Search ..... 432/103, 105, 432/117; 110/105, 246, 346; 414/149, 199

[56] References Cited

U.S. PATENT DOCUMENTS

| | | | |
|---|---|---|---|
| 4,348,968 | 9/1982 | Demar | 110/344 |
| 4,930,965 | 6/1990 | Peterson et al. | 414/149 |
| 5,078,594 | 1/1992 | Tutt et al. | 432/103 |
| 5,083,516 | 1/1992 | Benoit et al. | 110/344 |

FOREIGN PATENT DOCUMENTS

| | | | |
|---|---|---|---|
| 521353 | 5/1940 | United Kingdom . | |
| WO 90/05782 | 5/1990 | WIPO | C12N 15/53 |
| WO 92/13245 | 8/1992 | WIPO | F27B 15/00 |

*Primary Examiner*—Henry A. Bennett
*Assistant Examiner*—Siddharth Ohri
*Attorney, Agent, or Firm*—Deveau, Colton & Marquis

[57] ABSTRACT

A closure mechanism (16) for controlling charging of material through a port into a rotary kiln such as a cement kiln comprises a first and second portion (24,26), and a passage (29) which communicates with the port (12) to enable material to pass into the kiln when the mechanism is open. The first portion (24) acts to prevent reactive material passing through the passage and the closure (26) acts to close the port when the mechanism is in a closed position. The mechanism is movable to enable material such as tires to pass into the kiln but helps prevent premature degradation of the material by the heat of the kiln when the mechanism is closed.

12 Claims, 2 Drawing Sheets

KILN CLOSURE MECHANISM

Figure 1:
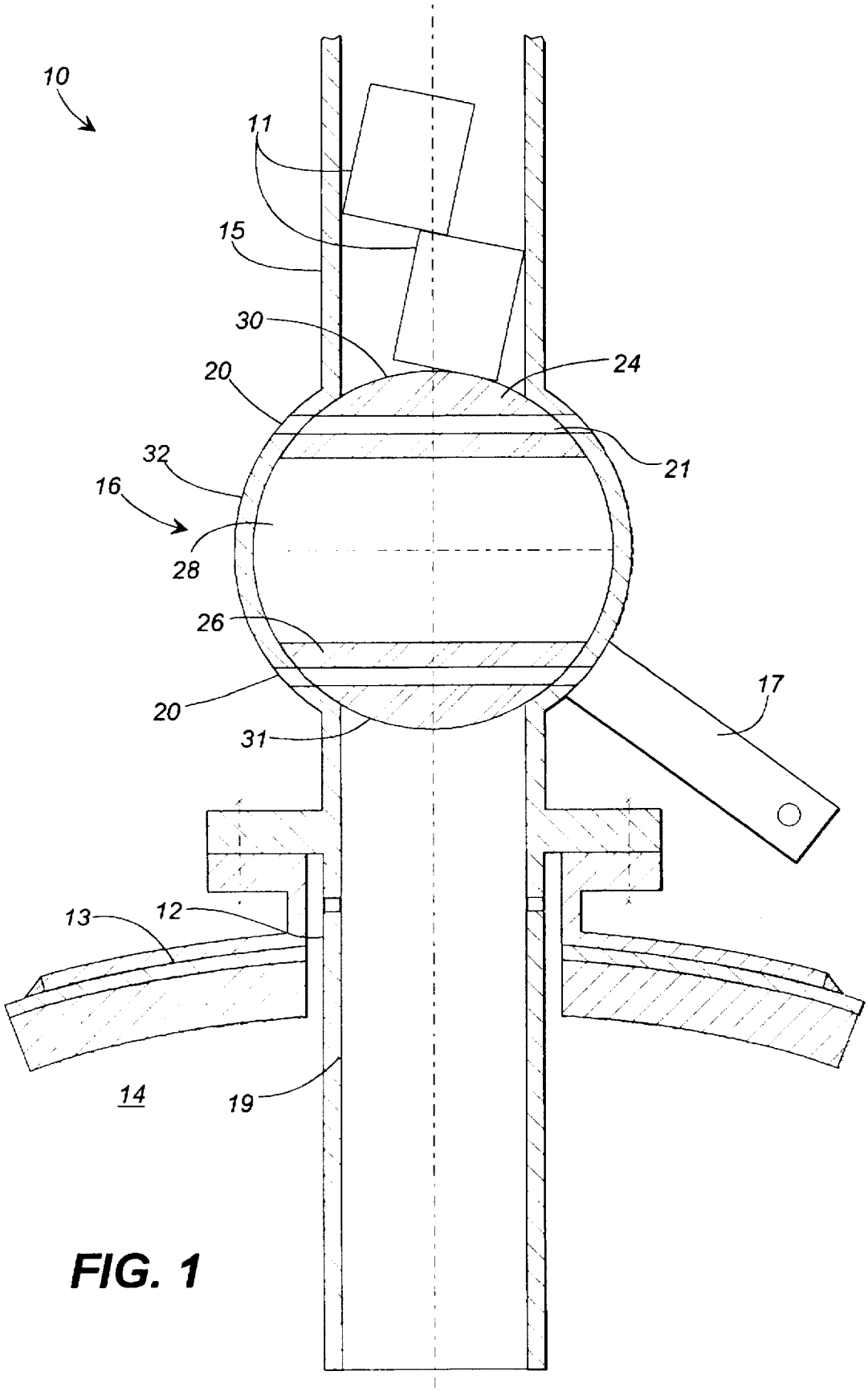

The invention relates to a closure mechanism for a kiln port and more particularly to a mechanism for adding material to a rotary kiln such as a cement kiln.

It is known from W092/13245 to provide a device for charging tires into rotary kilns comprising a material transfer assembly and port closure fixedly attached to the wall of the rotating kiln at a point in the hot zone of the kiln. The transfer assembly is of a generally known type which picks up one or more tires during the revolution of the kiln and presents the tires adjacent a port closure near the side of the wall of the kiln. As the kiln rotates so that the port and transfer assembly are substantially vertical, a cam mechanism operates to open the port enabling the tires to be fed under gravity into the kiln.

The known port closure comprises an inner and outer portion which each close at least part of the port. The portions overlap in a manner so as to provide an air flow path for ambient air through the port portions to the kiln. In this manner it is intended to keep the outer overlapping port portion cool since it is against this portion that part of a tire rests during rotation of the kiln from the tire pick up point to the vertical feed point.

The general problem in the art is due to the operating temperature of the kiln, for example, the gases in the kiln can have a temperature of around 1200° C. Thus the temperature at a charging port can be considerable and tires might degrade or disintegrate prematurely if they are subjected to these high temperatures. A problem with the specific known art is that for example if too small an overlap portion is provided by the inner and outer port portions then only a small region of the outer portion is protected from the heat of the kiln and it is therefore necessary to ensure that a tire rests against this small overlap portion.

Additionally, since the known art presents part of the port portion against which a tire rests directly to the heat of the kiln, this portion is heated greatly by the hot gases in the kiln and by radiation from the kiln. The overlap portion will therefore be required to be cooled from a relatively high temperature. In the known art this is done using a mechanically induced air flow path between relatively small parts of the overlapping portions. Air is drawn into the kiln through the path from outside the kiln by suction created in the kiln by fans in the kiln.

The present invention seeks to avoid or at least mitigate these and other problems of the known art. Accordingly, in one aspect the invention provides a closure mechanism for controlling charging of material through a port into a rotary kiln, the mechanism comprising a first and second portion and a passage which communicates with the port, the first portion acting to prevent material passing through the passage and the second portion acting to close the port when the closure mechanism is in a closed position, the closure mechanism being movable to enable material to pass through the passage into the kiln when open and acting to protect the material from degradation by the heat of the kiln when closed.

Preferably the closure mechanism comprises a rotary valve mechanism which is rotatable from the closed to the open position to enable the material to enter the kiln.

More preferably a closure mechanism according to the invention has a first portion and a second portion which are formed by a substantially cylindrical valve portion through which the passage passes substantially radially.

In a preferred form of this aspect of the invention the mechanism is biased to a closed position by resilient means such as a coiled spring for example.

A further feature of the invention provides an operating device adapted to cooperate with an actuating device thereby to move the closure mechanism from a closed position to an open position. More preferably, the operating device is an arm having means adapted to cooperate with a cam which forms part of the actuating device.

In a further preferred form of the present invention the mechanism comprises means adapted to cool the mechanism though the flow of ambient air under convection.

Another preferred feature of this aspect of the invention provides that the second portion is contained in a housing comprising at least one cooling port, the second portion comprising at least one duct which passes through the second portion and interconnects with the cooling port to provide an air flow path which is preferably for ambient air drawn under convection for example through the second portion when the closure mechanism is closed.

Alternatively, the first portion can be contained in a housing comprising at least one cooling port, the first portion comprising at least one duct which passes through the first portion and interconnects with the cooling port to provide an air flow path which is preferably for ambient air drawn under convection for example through the first portion when the closure mechanism is closed. Further, an air flow path can be provided through the closure portion and/or the first portion when the closure mechanism is open.

Another aspect of the invention is use of the closure mechanism according to the invention for feeding material such as tires into a rotary cement kiln.

Another aspect of the invention provides a feed mechanism for a port of a rotary kiln comprising a closure mechanism according to preceding paragraphs and transfer means for collecting reactive material from a stored position.

Another aspect of the invention provides a rotary kiln comprising a closure mechanism and/or feed mechanism according to preceding paragraphs.

A further aspect of the invention provides a method of charging material through a port into a rotary kiln comprising the steps of temporarily loading material against a protective screen proximal the port, moving the protective screen and a port closure thereby to enable the reactive material to pass through the port into the kiln.

Preferably the material passes through the port due to gravity. Also, the protective screen and closure can form part of a rotary valve which is moved to enable the material to enter the kiln by rotation of the valve.

Another aspect provides a closure mechanism for controlling charging of material through a port of a rotary kiln such as a cement kiln comprising a passage which communicates with the port to enable reactive material to pass into the kiln when the mechanism is open, a first portion which acts to prevent reactive material passing through the mechanism and a closure which acts to close the port when the mechanism is in a closed position, wherein the mechanism is movable to enable the material to pass into the kiln but restricts premature degradation of the material by the heat from the kiln when the mechanism is closed.

A further aspect provides a closure mechanism for controlling charging of material through a port of a rotary kiln comprising a rotary valve mechanism such as a rotary plug valve.

Figure 2:
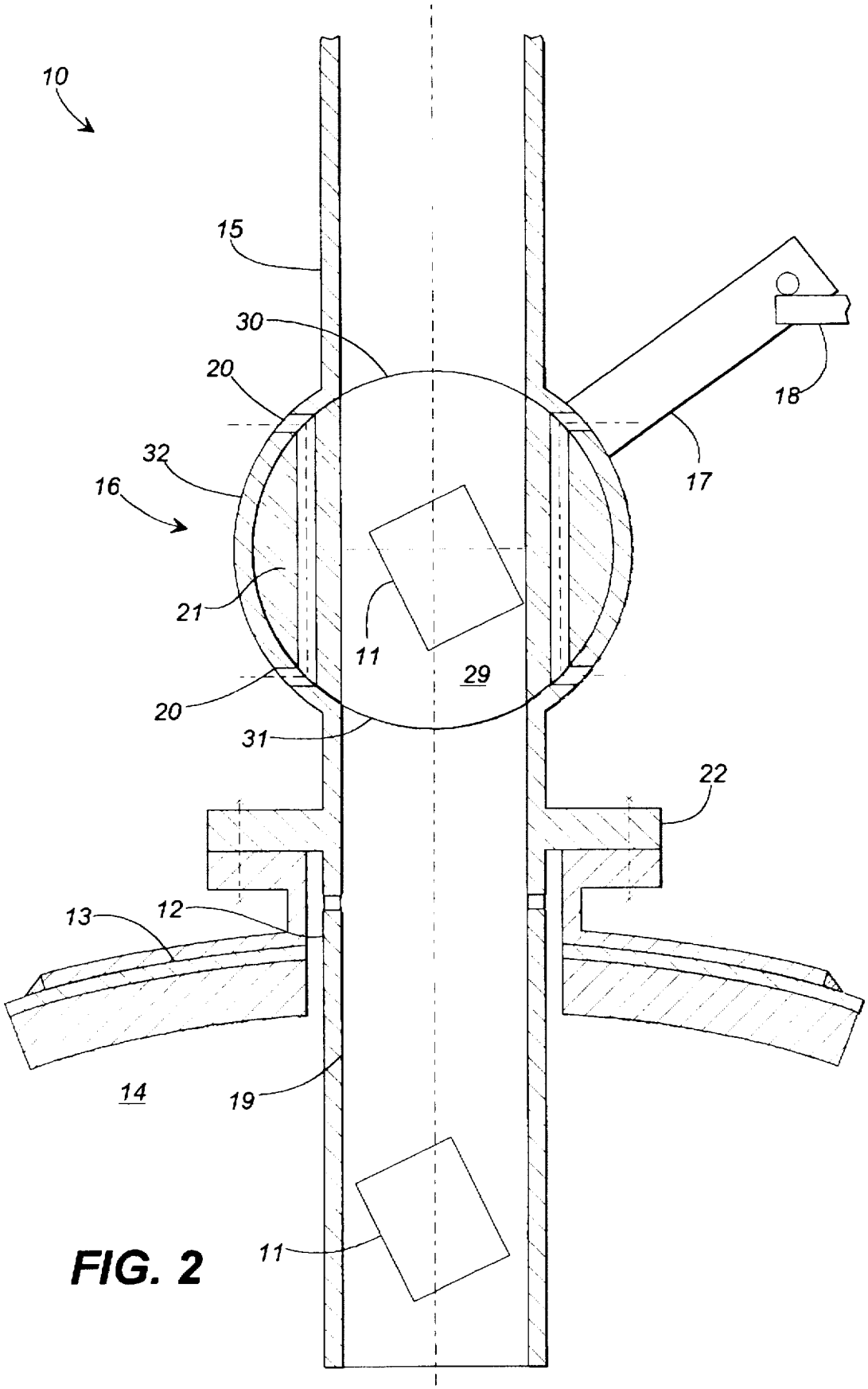

An embodiment of the invention will now be described, by way of example only with reference to the accompanying drawings, in which:

FIG. 1 shows a closure mechanism according to the invention in a closed position; and FIG. 2 shows the closure mechanism shown in FIG. 1 in an open position.

The drawings shown are schematic sectional views of the feed mechanism 10 and only part of the outer wall of a kiln 14. The kiln could for example be a large cement kiln of a generally known type (which have a substantially cylindrical structure) where the feed mechanism 10 is added in order to enable materials 11 to enter the mineral bed being heated in the kiln. The material could be virtually anything including materials which one might wish to incinerate or additives, or precursors therefor, which one might wish to incorporate into the final product of the kiln for example. The material might also be a combustible material which can contribute towards the heating of the raw materials in the kiln, thus supplementing the normal kiln fuel.

The material thereby might provide combustible fuel material at a hot part of the kiln intermediate its ends.

The material 11 could be tires, containerised fluid or containerised medical waste, for example. The invention therefore provides the benefit that waste materials (including toxic waste) from other industries can be incinerated and disposed of at the same time as providing in some cases fuel or feed stock for a kiln. Of course, not all material need react exothermically.

FIG. 1 shows a feed mechanism 10 according to the invention which comprises a feed chute 15, a closure mechanism 16 and an extension tube 19. Extension tube 19 passes through a port 12 in a wall 13 of kiln 14. The feed mechanism 10 comprises a flange 22 which is fixed to collar 13 adjacent port 12.

The closure mechanism 16, could generally be described as a rotary plug valve in this embodiment. It comprises an outer portion 24, an inner closure 26 and a connector plate 28. These are rotatably mounted on an axle not shown which can be held in a bearing mount. An actuating arm 17 is attached to the axle and enables the outer portion 24 and inner closure 26 to be rotated from the position shown in FIG. 1 to that in FIG. 2. Such rotation thereby provides a communication passage 29 through the closure mechanism 16 from feed chute 15 to extension tube 19 and into the kiln. The mechanism is biased, for example by a coiled spring mechanism attached to the axle, so that it returns to its closed position.

The closure 26 and outer portion 24 are retained in an outer wall 32 having cooling ports 20. The outer portion 24 and closure 26 comprise ducts 21 which operatively interconnect two or more cooling ports thereby enabling ambient air to flow through the inner closure and outer portion to cool each towards the ambient air temperature. The air flow provided here is due to natural convection created by a temperature differential between parts of the mechanism and the ambient air outside the kiln. The air flows from the surrounding air through the mechanism and back to the surroundings. However, it is envisaged that the air flow could also be mechanically assisted for example by using fans external to the kiln.

A beneficial feature of the invention as seen by comparing FIGS. 1 and 2 is that the outer portion 24 remains virtually unexposed to direct radiant heat from inside the kiln during the operating process. In the closed position outer portion 24 is protected from heat by closure 26 and after rotation through 90° to the open position it is aligned substantially radially to the kiln and therefore remains unexposed to radiant heat.

The mechanism can operate automatically as the kiln rotates such that for example when the kiln shown in FIG. 1 is rotating clockwise a transfer mechanism can present material 11 into feed chute 15 when apparatus 10 is near the horizontal. As the kiln rotates further clockwise an actuating device 18 can act on operating arm 17 causing the closure mechanism 16 to rotate thereby enabling the material 11 to pass, for example due to gravity, through inlet 30 of the closure mechanism and out through outlet 31 into the kiln 14.

The actuating device 18 could be a cam device having a fixed location relative to the central axis of the substantially cylindrical kiln. In particular, the end of actuating device 18 could be shaped so as to hold the closure mechanism 16 in an open position during an extended period of the rotation of the kiln before releasing the operating arm 17 which is biased to cause the closure mechanism to close.

In order further to assist in preventing the reactive material jamming the mechanism, the diameter of the inner bore of chute 15 is less than the diameter of passage 29 which is again less than the diameter of extension tube 19.

It should be noted that the drawings shown are only schematic and for example extension tube 19 should be dimensioned to prevent the material bed which slides around inside the kiln from falling back through the tube to the closure mechanism.

I claim:

1. A closure mechanism for controlling charging of materials through a port into a rotary kiln, the mechanism comprising a movable element movable between an open position and a closed position, said movable element further comprising a first portion, a second portion and a passage between said first and second portions, wherein when said movable element is in the open position the materials can pass through said passage into the kiln, and when said movable element is in the closed position said second portion closes the port and said first portion retains the material remote from the port.

2. A closure mechanism according to claim 1 wherein said movable element comprises a rotary valve mechanism which is rotatable from the closed to the open position to enable the material to enter the kiln.

3. A closure mechanism according to claim 2 wherein the first portion and the second portion are substantially radially opposite portions of a cylindrical valve portion through which said passage passes.

4. A closure mechanism according to claim 1 wherein the mechanism is biased to the closed position by resilient means.

5. A closure mechanism according to claim 1 comprising an operating device adapted to cooperate with an actuating device thereby to move said movable element from the closed position to the open position.

6. A closure mechanism according to claim 5 wherein the operating device is an arm having means adapted to cooperate with a cam which forms part of the actuating device.

7. A closure mechanism according to claim 1 comprising means adapted to cool the mechanism through the flow of ambient air under convection.

8. A closure mechanism according to claim 1 wherein the second portion is contained in a housing comprising at least one cooling port, the second portion comprising at least one duct which passes through the second portion and interconnects with the cooling port to provide an air flow path for ambient air through the second portion when the closure mechanism is in the closed postion.

9. A closure mechanism according to claim 8 wherein an air flow path is also provided through the second portion when the closure mechanism is in the open position.

10. A closure mechanism according to claim 1 wherein the first portion is contained in a housing comprising at least one cooling port, the first portion comprising at least one duct which passes through the first portion and interconnects with the cooling port to provide an air flow path for ambient air through the first portion when the closure mechanism is in the closed position.

11. A closure mechanism according to claim 10 wherein an air flow path is also provided through the first portion when the closure mechanism is in the open position.

12. A closure mechanism according to claim 1 wherein said movable element is contained in a housing comprising at least two cooling ports, the second portion comprising at least one duct which passes through the second portion and interconnects with one of said at least two cooling ports to provide an air flow path for ambient air through the second portion when the closure mechanism is in the closed position, and wherein an air flow path is also provided through the second portion when the closure mechanism is in the open position, and wherein the first portion is contained in said housing, the first portion comprising at least one duct which passes through the first portion and interconnects with one of said at least two cooling ports to provide an air flow path for ambient air through the first portion when the closure mechanism is in the closed position, and wherein an air flow path is also provided through the first portion when the closure mechanism is in the open position.

* * * * *